US007448738B2

(12) United States Patent
Okamura

(10) Patent No.: US 7,448,738 B2
(45) Date of Patent: Nov. 11, 2008

(54) RECORDING APPARATUS

(75) Inventor: Yoshitaka Okamura, Yamato (JP)

(73) Assignee: Canon Kabushiki Kaisha, Tokyo (JP)

( * ) Notice: Subject to any disclaimer, the term of this patent is extended or adjusted under 35 U.S.C. 154(b) by 411 days.

(21) Appl. No.: 11/432,051

(22) Filed: May 11, 2006

(65) Prior Publication Data

US 2006/0262158 A1 Nov. 23, 2006

(30) Foreign Application Priority Data

May 19, 2005 (JP) ..... 2005-146381

(51) Int. Cl.
*B41J 2/175* (2006.01)

(52) U.S. Cl. ..... 347/86

(58) Field of Classification Search ..... 347/86, 347/20, 22–37, 49, 50
See application file for complete search history.

(56) References Cited

U.S. PATENT DOCUMENTS 4,872,026 A * 10/1989 Rasmussen et al. ..... 347/56
4,907,018 A 3/1990 Pinkerpell et al.
5,245,361 A * 9/1993 Kashimura et al. ..... 347/50
6,027,209 A * 2/2000 Menendez et al. ..... 347/85
6,296,345 B1 * 10/2001 Kline et al. ..... 347/49
6,481,829 B1 * 11/2002 Bailey et al. ..... 347/49
2003/0138280 A1 7/2003 Namekawa et al.

* cited by examiner

*Primary Examiner*—Shih-wen Hsieh
(74) *Attorney, Agent, or Firm*—Canon USA Inc I.P. Div

(57) ABSTRACT

A recording apparatus includes a recording-head replacing portion, a feeding unit that feeds a recording sheet, and an eject unit that ejects the recording sheet on a front side of the apparatus. The apparatus further includes a head mount that is movable between the carriage and the head-replacing portion while the recording head is mounted on the head mount, a head-lowering member that moves the recording head from the carriage to the head mount, and a head-pushing member that moves the recording head mounted from the head mount to the carriage.

6 Claims, 16 Drawing Sheets

RECORDING APPARATUS

BACKGROUND OF THE INVENTION

1. Field of the Invention

The present invention relates to a recording apparatus including a carriage to which a recording head can be detachably attached.

2. Description of the Related Art

U.S. Pat. No. 4,907,018 discusses an attach/detach mechanism for a carriage and a recording head in which a three-directional positioning reference for the recording head is provided on the carriage, and the recording head is positioned by urging the recording head with an elastic body.

In addition, recently, attempts have been made to establish networks by connecting personal computers to AV devices and household electric appliances. Accordingly, it is anticipated that there will be demand for printers that can be placed on racks, such as TV stands, similar to other AV devices.

In such a case, the printers must be structured such that all of the operations required for printing can be performed on the front side of the printer body. More specifically, it is necessary that operations of setting recording sheets before starting printing, taking out the recording sheets after printing, and replacing recording heads when ink runs out can be performed on the front side of the printer body.

An inkjet recording apparatus structured such that operations of setting recording sheets before starting printing and taking out the recording sheets after printing is discussed in U.S. Patent Application Publication Ser. No. 2003/138280.

However, the above-mentioned publication does not discuss the operation of replacing ink units or recording heads in the inkjet recording apparatus. In a typical inkjet recording apparatus, the operation of replacing the recording heads is performed manually, and a cover that opens wide is generally provided so that a user can easily access a carriage to replace the ink units or the recording heads. This type of cover generally opens in a region extending over the front and top sides of the apparatus and cannot be opened when the apparatus body is placed on a rack as described above.

Recording apparatuses in which only a recording head is mounted on a carriage and an ink tank is placed at a position where a user can easily access are also known. In such apparatus, the recording head is connected to the ink tank with an elastic tube so that ink can be supplied to the recording head. Although this type of apparatus can be structured such that the operation of replacing ink tanks can be performed on the front side, there are problems that the size and cost of the apparatus are increased since the tube must be connected to the carriage.

SUMMARY OF THE INVENTION

The present invention is directed to a recording apparatus structured such that all operations of feeding recording sheets, ejecting the recording sheets, and replacing recording heads can be performed on a front side of the apparatus without increasing costs.

According to one aspect of the present invention, a recording apparatus that records on a recording sheet with a detachable recording head includes an apparatus body having a front side; a carriage movably supporting the detachable recording head; a head-replacing portion arranged on the front side of the apparatus body and operable to perform a recording-head replacing operation; a feeding unit arranged on the front side of the apparatus body and configured to feed the recording sheet; an eject unit that is arranged on the front side of the apparatus body and configured to eject the recording sheet; a head mount adapted to mount the recording head and movable between the carriage and the head-replacing portion; a lowering member configured to move the recording head mounted on the carriage to the head mount; and a pushing member configured to move the recording head mounted on the head mount to the carriage.

Further features of the present invention will become apparent from the following description of exemplary embodiments with reference to the attached drawings.

DESCRIPTION OF THE EMBODIMENTS

First Embodiment

Figure 1:
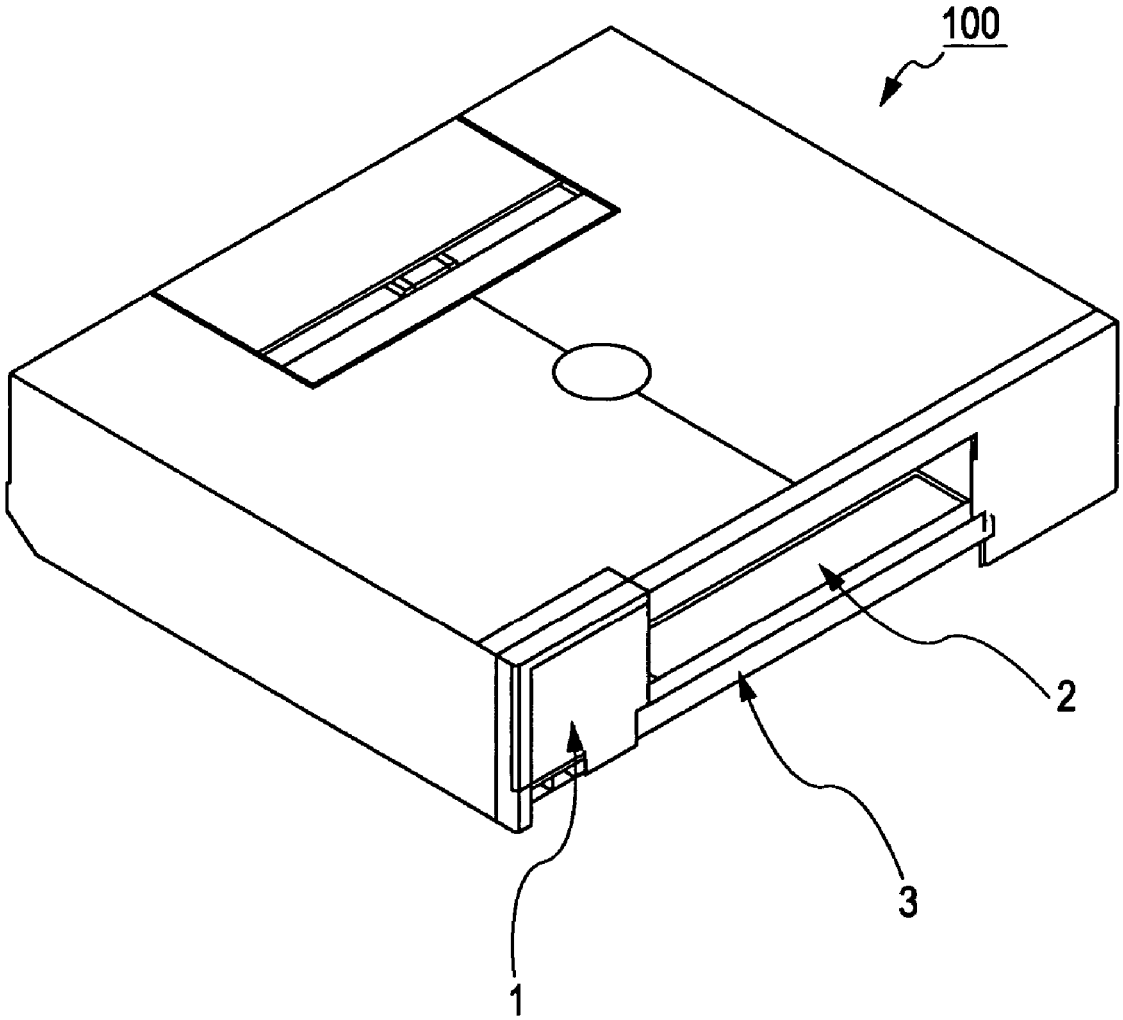
FIG. 1 is a perspective view illustrating an inkjet recording apparatus according to a first embodiment of the present invention.
Figure 2:
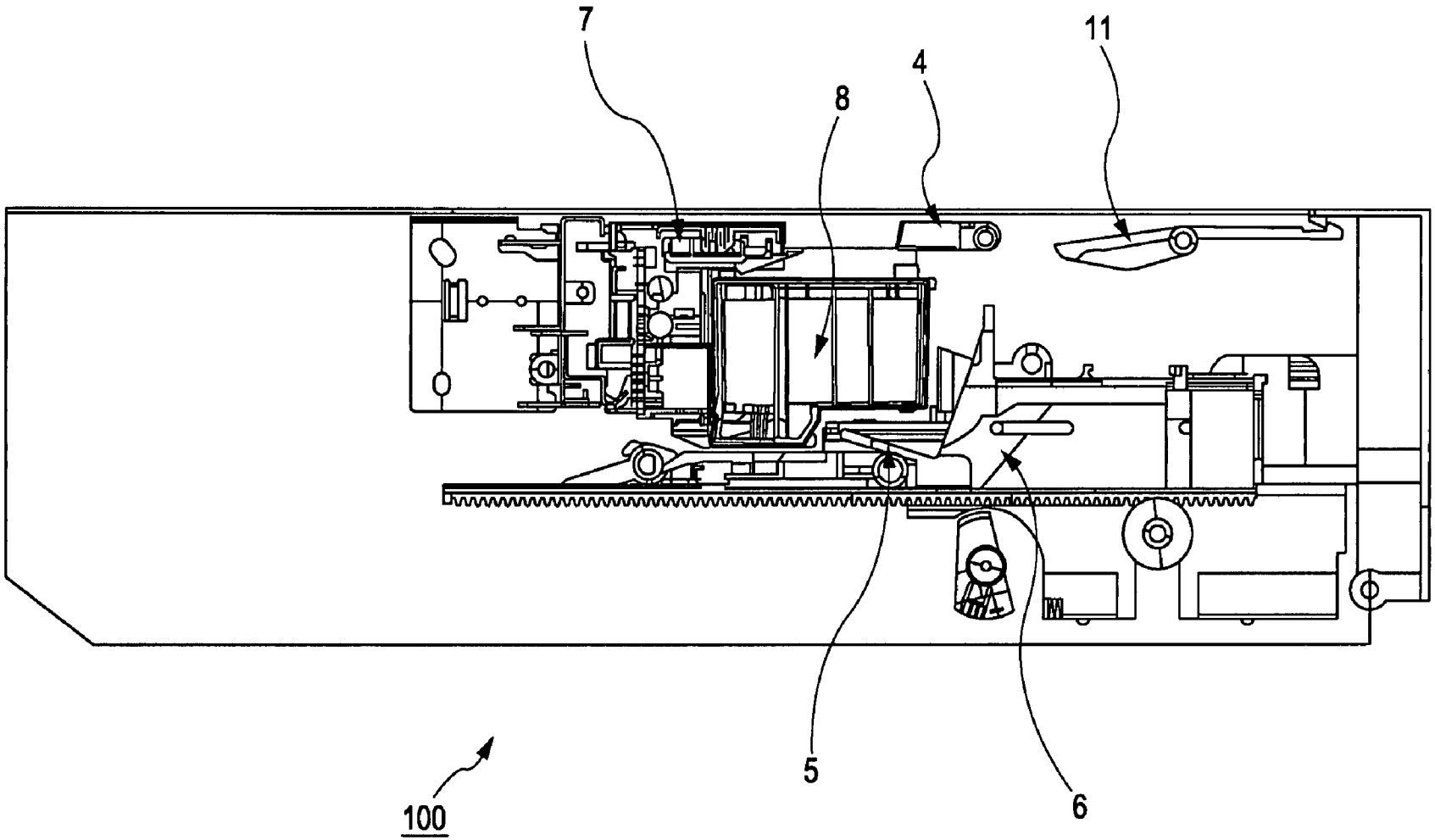
FIG. 2 is a principal sectional view illustrating the inkjet recording apparatus.

An inkjet recording apparatus according to a first embodiment of the present invention will be described below with reference to the drawings. FIG. 1 is a perspective view illustrating an inkjet recording apparatus according to a first embodiment of the present invention. FIG. 2 is a principal sectional view illustrating the inkjet recording apparatus.

Referring to FIGS. 1 and 2, an inkjet recording apparatus 100 includes a recording-head replacing door 1 that functions as a recording-head replacing portion, an eject portion 2 that functions as an eject unit, a feed cassette 3 that functions as a feed unit, a carriage 7, and recording heads 8. A recording sheet is fed from the feed cassette 3 into the inkjet recording apparatus 100, where printing is performed, and is ejected through the eject portion 2. The carriage supports the recording heads.

Figure 4:
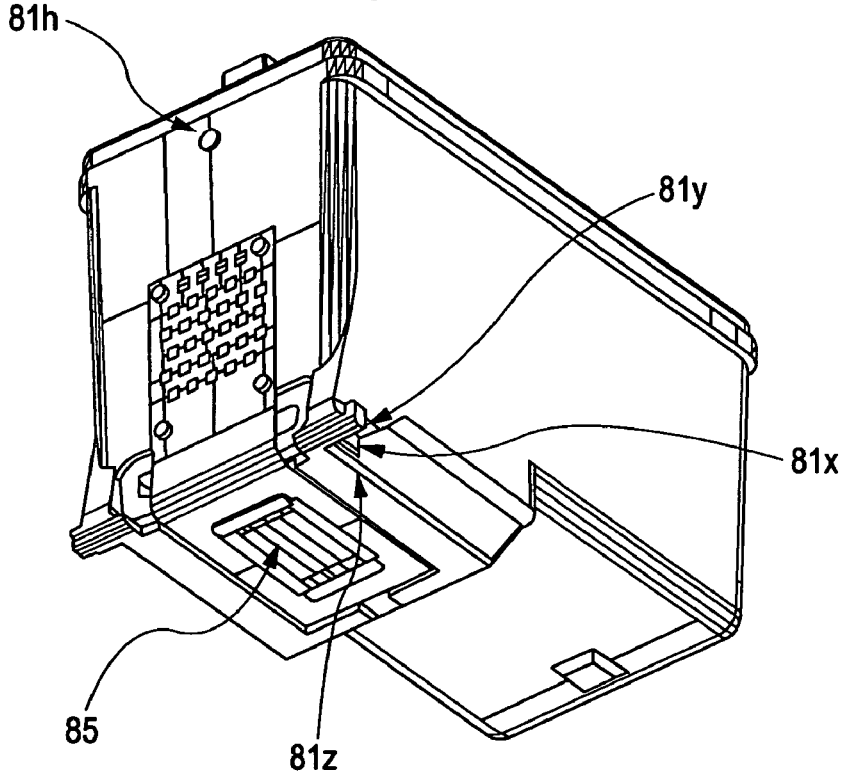
FIG. 4 is another perspective view illustrating the recording head.

Referring to FIG. 4, each recording head 8 has two positioning reference units provided at the bottom for positioning the recording head 8 with respect to the carriage 7. Each positioning reference unit includes a positioning reference surface 81*x* in a carriage-scanning direction (X direction), a positioning reference surface 81*y* in a sheet-conveying direction (Y direction), and a positioning reference surface 81*z* in a direction perpendicular to the carriage-scanning direction and the sheet-conveying direction (z direction). The two positioning reference units, each of which includes the positioning reference surfaces 81*x*, 81*y*, and 81*z* are arranged symmetrically with respect to nozzle lines 85 provided on the bottom surface of the recording head 8. An image-recording operation is performed by discharging ink from the recording head 8 while conveying a recording sheet so as to pass through a position where the recording sheet faces the nozzle lines 85.

Figure 3:
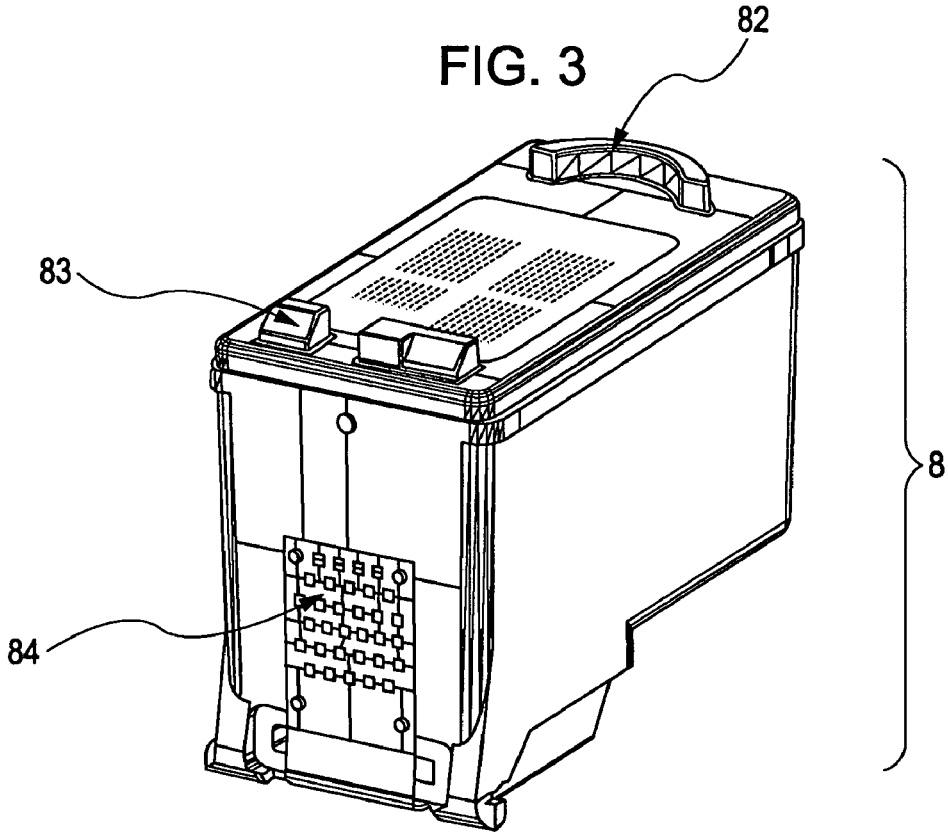
FIG. 3 is a perspective view illustrating a recording head.

As shown in FIG. 3, each recording head 8 includes a finger tab 82, a head-fixing portion 83, an electrical contact section 84, and an inclination restricting surface 81*h*. The finger tab 82 is not used under operation, but a user can place his or her finger on the finger tab 82 in the operation of attaching or detaching the recording head 8 to/from the carriage 7 in the recording apparatus 100. The electrical contact section 84 applies a current to electrothermal transducers included in the recording head 8 in accordance with recording signals. Film boiling occurs in the ink due to heat energy applied by the current, and accordingly bubbles are generated in the ink. Then, ink drops are discharged from nozzles due to expansion and contraction of the generated bubbles.

Recording-Head Positioning Operation

Figure 9:
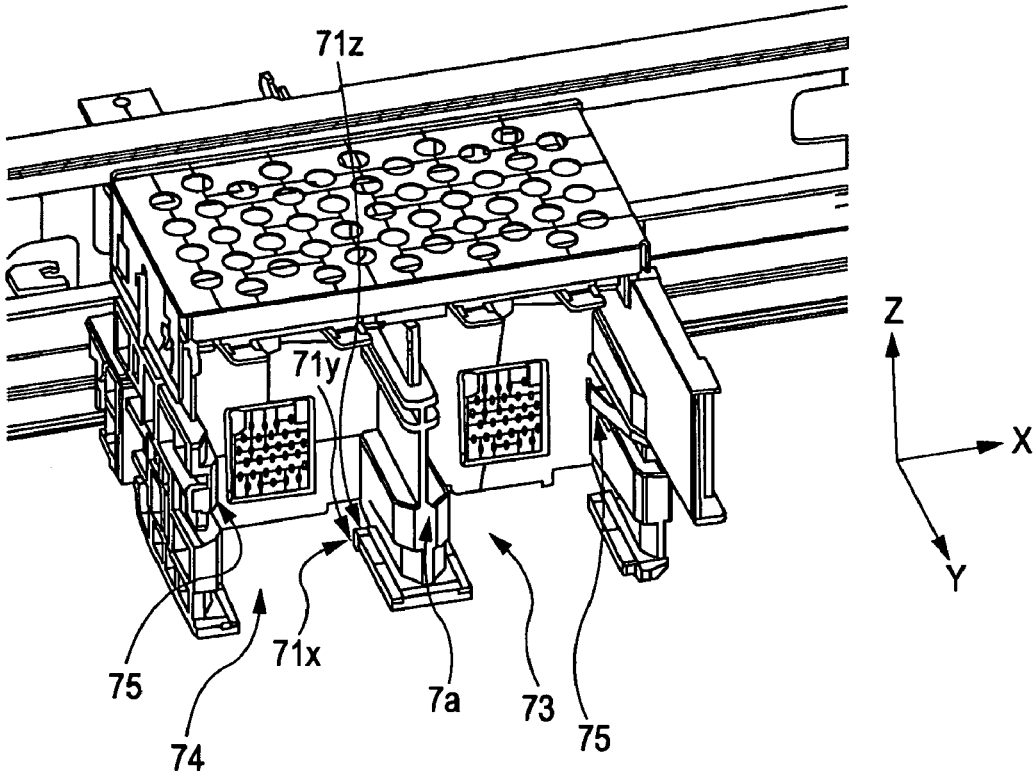
FIG. 9 is a perspective view illustrating a carriage.

Next, the operation of positioning the recording heads 8 with respect to the carriage 7 will be described below. FIG. 9 is a perspective view of the carriage 7. As shown in FIG. 9, the carriage 7 includes pockets 73 and 74 and thrust springs 75.

The pockets 73 and 74 receive the respective recording heads 8. For example, a black recording head (not shown) containing only black ink and a color recording head (not shown) containing yellow ink, magenta ink, and cyan ink are mounted in the pockets 73 and 74. Alternatively, a photo recording head containing photo ink (light black, light magenta, and light cyan) may also be mounted instead of the black recording head.

The carriage 7 has positioning reference units provided at the bottom, each positioning reference unit including an X-direction positioning reference surface 71*x*, a Y-direction positioning reference surface 71*y*, and a Z-direction positioning reference surface 71*z*. The thrust springs 75 urge the recording heads 8 toward the corresponding X-direction positioning reference surfaces 71*x* to bias the recording heads 8 in the X direction. The thrust springs 75 are respectively disposed on the opposite walls of the carriage 7, and accordingly the X-direction positioning reference surfaces 71*x* are provided only on a center wall 7*a* of the carriage 7.

Figure 10:
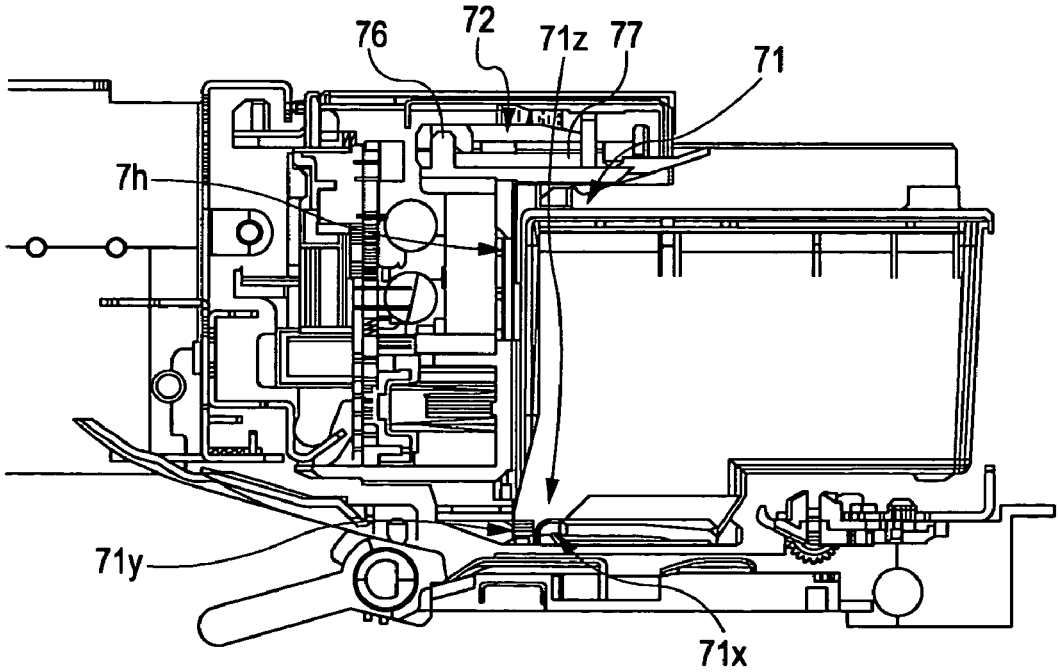
FIG. 10 is a principal sectional view illustrating the carriage.

FIG. 10 is a sectional view illustrating the state in which the recording heads 8 are mounted on the carriage 7. As shown in FIG. 10, when each recording head 8 is mounted on the carriage 7, the positioning reference surfaces 71*x*, 71*y*, and 71*z* in the three directions are in contact with the positioning reference surfaces 81*x*, 81*y*, and 81*z*, respectively.

In addition, a head-setting spring 72 exerts an elastic force so that a head-retaining member 71 is rotated about a shaft 76, and a cam surface 77 of the head-retaining member 71 comes into contact with the head-fixing portion 83 and pushes the recording head 8 downward. Components of the elastic force applied by the cam surface 77 serve as urging forces in the Y and Z directions that fix the recording head 8 in the Y and Z directions with the positioning reference surfaces 71*y*, 71*z*, 81*y*, and 81*z*. Accordingly, the positioning reference surfaces 71*y*, 71*z*, 81*y*, and 81*z* are prevented from being separated and displaced from each other during the printing operation.

In addition, an inclination restricting surface 7*h* receives the force applied by the recording head retaining member 71 and comes into contact with the inclination restricting surface 81*h* of the recording head 8. Therefore, the recording head 8 is prevented from being inclined.

Recording-Head Replacing Operation

Figure 11:
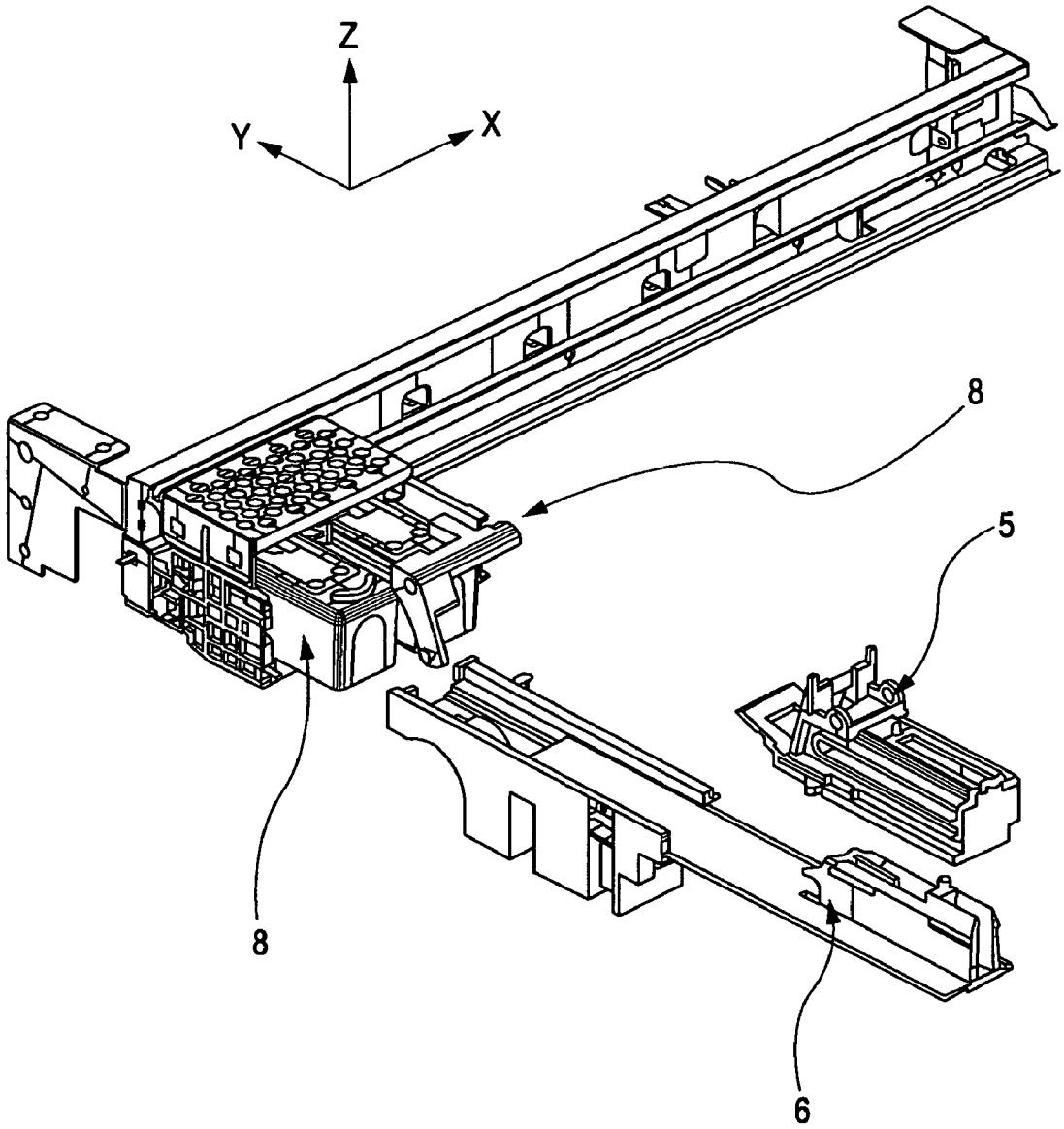
FIG. 11 is a perspective view illustrating recording heads and a head mount.

Next, the operation of replacing the recording heads 8 will be described below. As shown in FIGS. 2 and 11, the inkjet recording apparatus 100 includes a head-lowering member 4, a head mount 5, and a head-pushing member 6.

When a recording-head replacement command is issued, the carriage 7 moves in a main-scanning direction along the width of the sheet (X direction) from a normal standby position to a predetermined recording-head replacing position.

Figure 5:
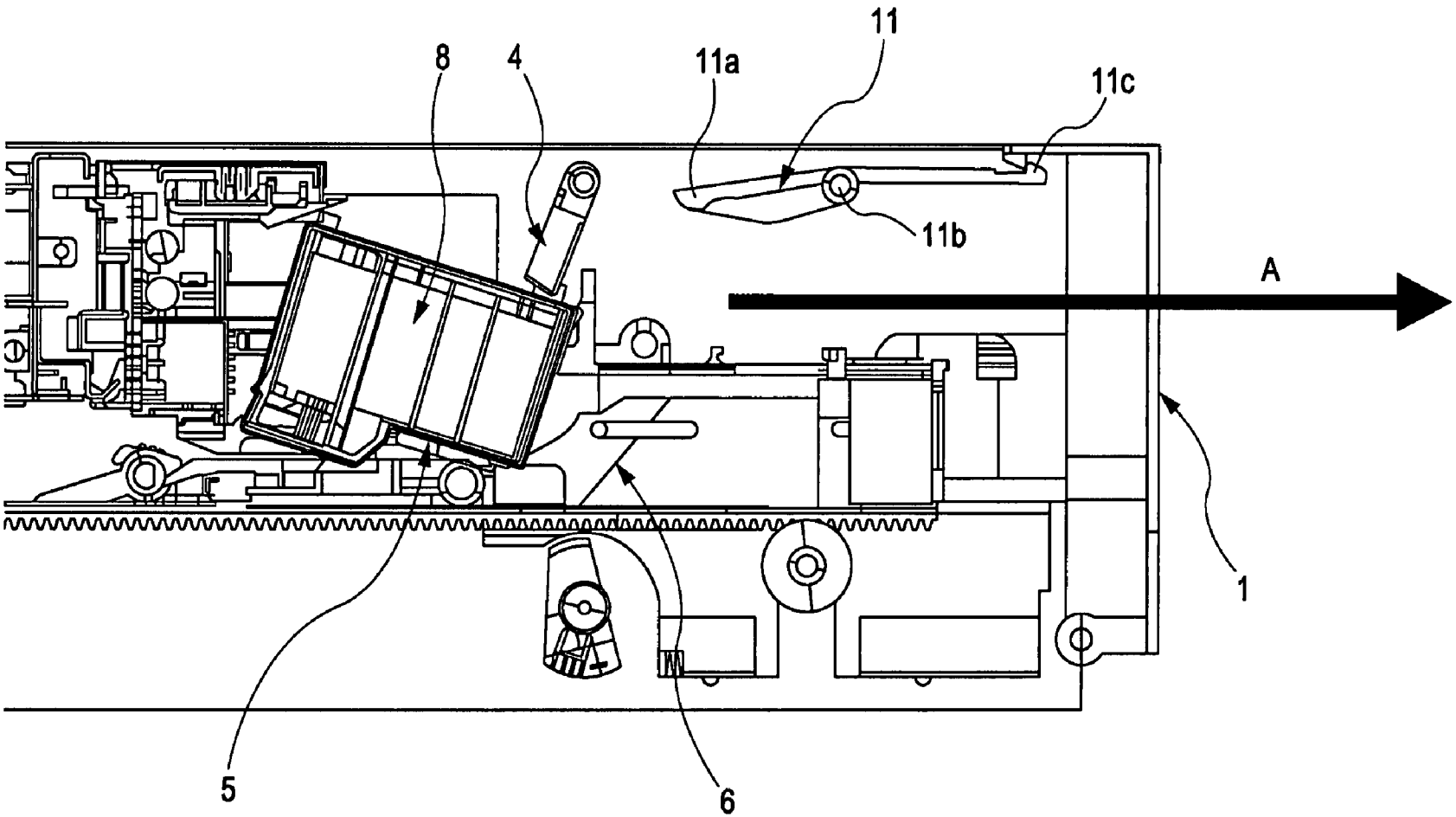
FIG. 5 is a diagram illustrating a recording-head replacing operation.

Then, as shown in FIG. 5, the head-lowering member 4 is rotated by the driving mechanism (not shown) and pushes the recording head 8 downward at an end of the recording head 8 in the sheet-conveying direction (Y direction). Accordingly, the recording head 8 rotates and moves onto the head mount 5. Thus, the recording head 8 is held by the head mount 5.

Figure 6:
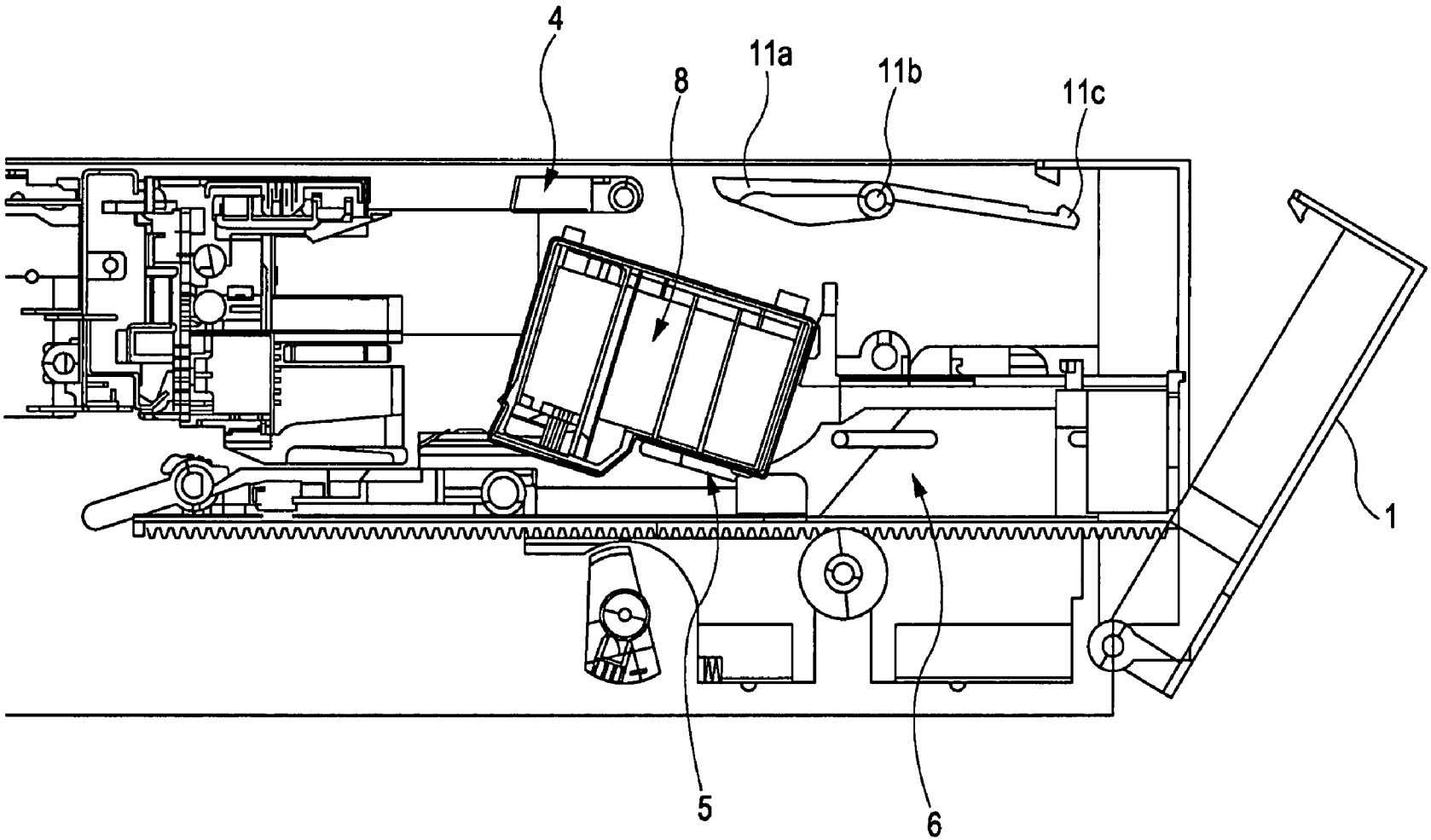
FIG. 6 is another diagram illustrating the recording-head replacing operation.

Then, the head mount 5 holding the recording head 8 is moved in the direction shown by the arrow A together with the head-pushing member 6. In addition, a member (not shown) that moves in the direction shown by the arrow A pushes an end 11*a* of a door lock member 11 upward, so that a lock portion 11*c* at an end opposite to the end 11*a* across a rotating shaft 11*b* is moved downward, as shown in FIG. 6. Accordingly, the recording-head replacing door 1 is released from the door lock member 11. Then, the head mount 5 pushes the recording-head replacing door 1 so as to open the recording-head replacing door 1.

Figure 7:
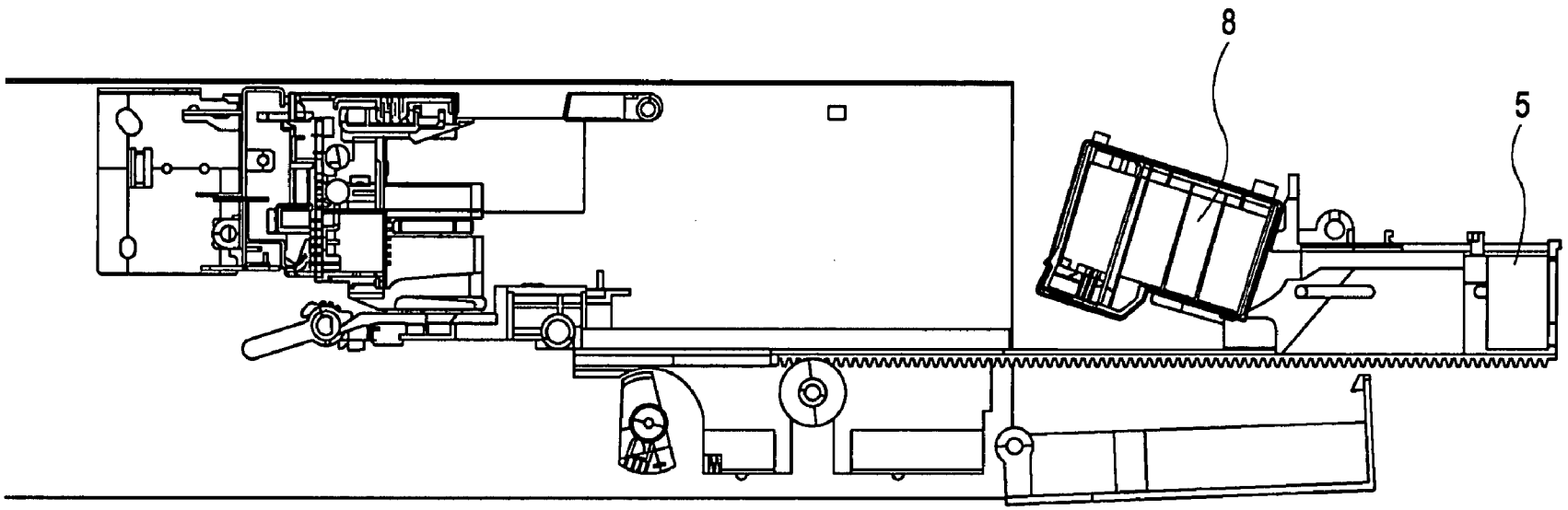
FIG. 7 is another diagram illustrating the recording-head replacing operation.
Figure 8:
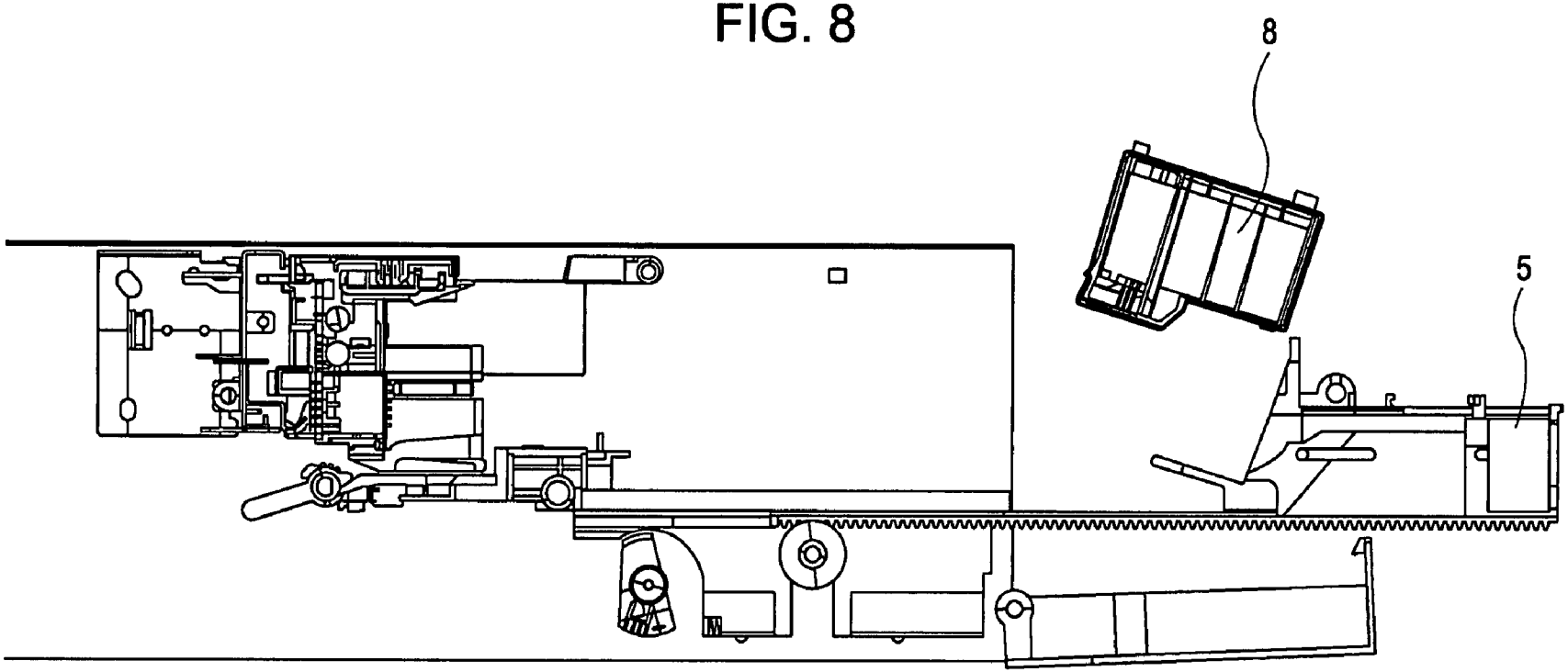
FIG. 8 is another diagram illustrating the recording-head replacing operation.

As shown in FIG. 7, the head mount 5 moves the recording head 8 out of the recording apparatus 100, and then stops. In this state, the user replaces the recording head 8 with another recording head 8, as shown in FIG. 8.

Figure 12:
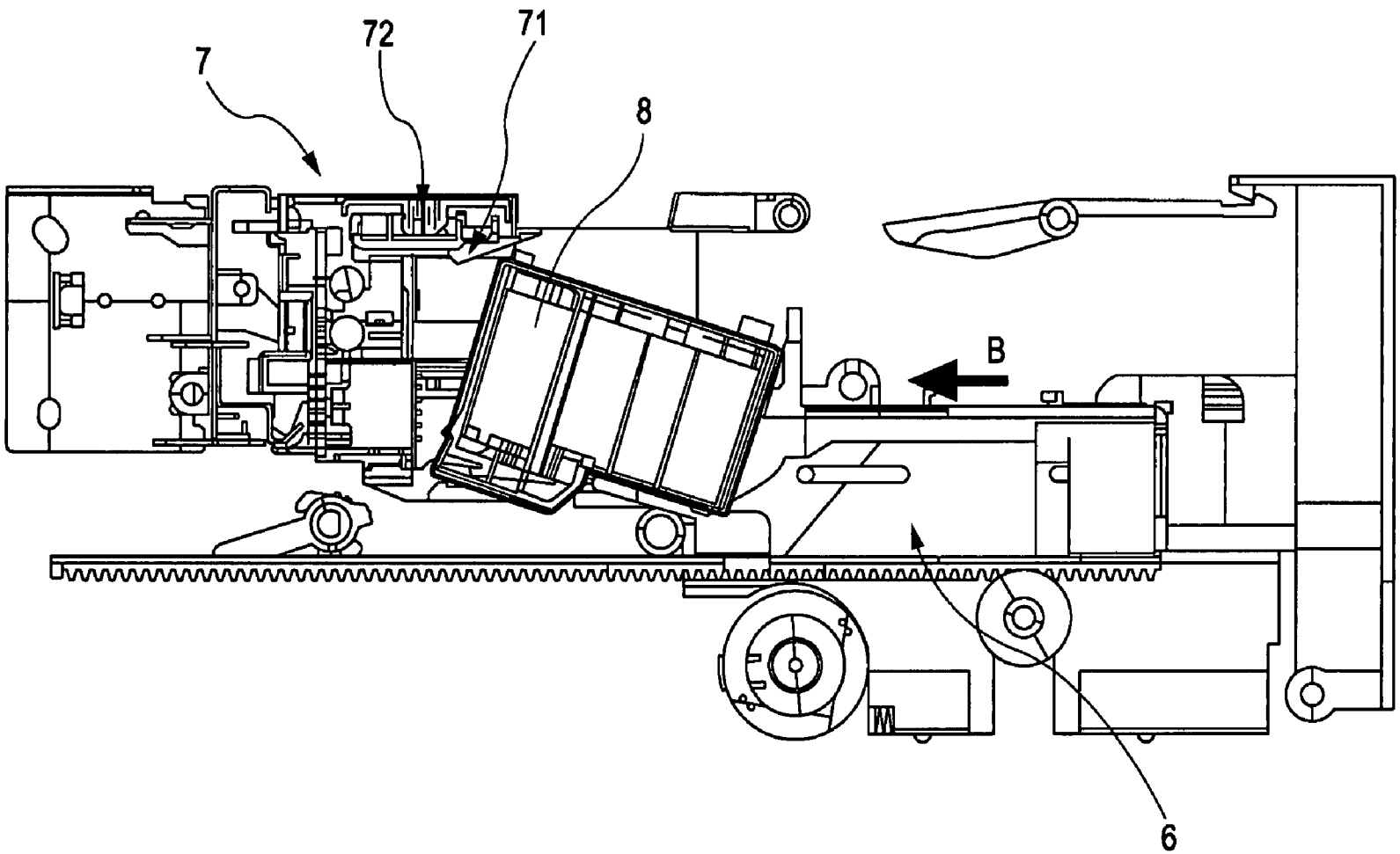
FIG. 12 is another diagram illustrating the recording-head replacing operation.

When the recording head 8 is attached, the operation opposite to the above-described operation is performed. More specifically, the recording head 8 is mounted on the head mount 5, and a head-mounting command is issued. Accordingly, as shown in FIG. 12, the head mount 5 on which the recording head 8 is mounted moves into the apparatus. The head mount 5 carries the recording head 8 toward the carriage 7 that is placed at the above-described head replacing position, and stops at a position where the head mount 5 does not interfere with the recording head 8.

Figure 13:
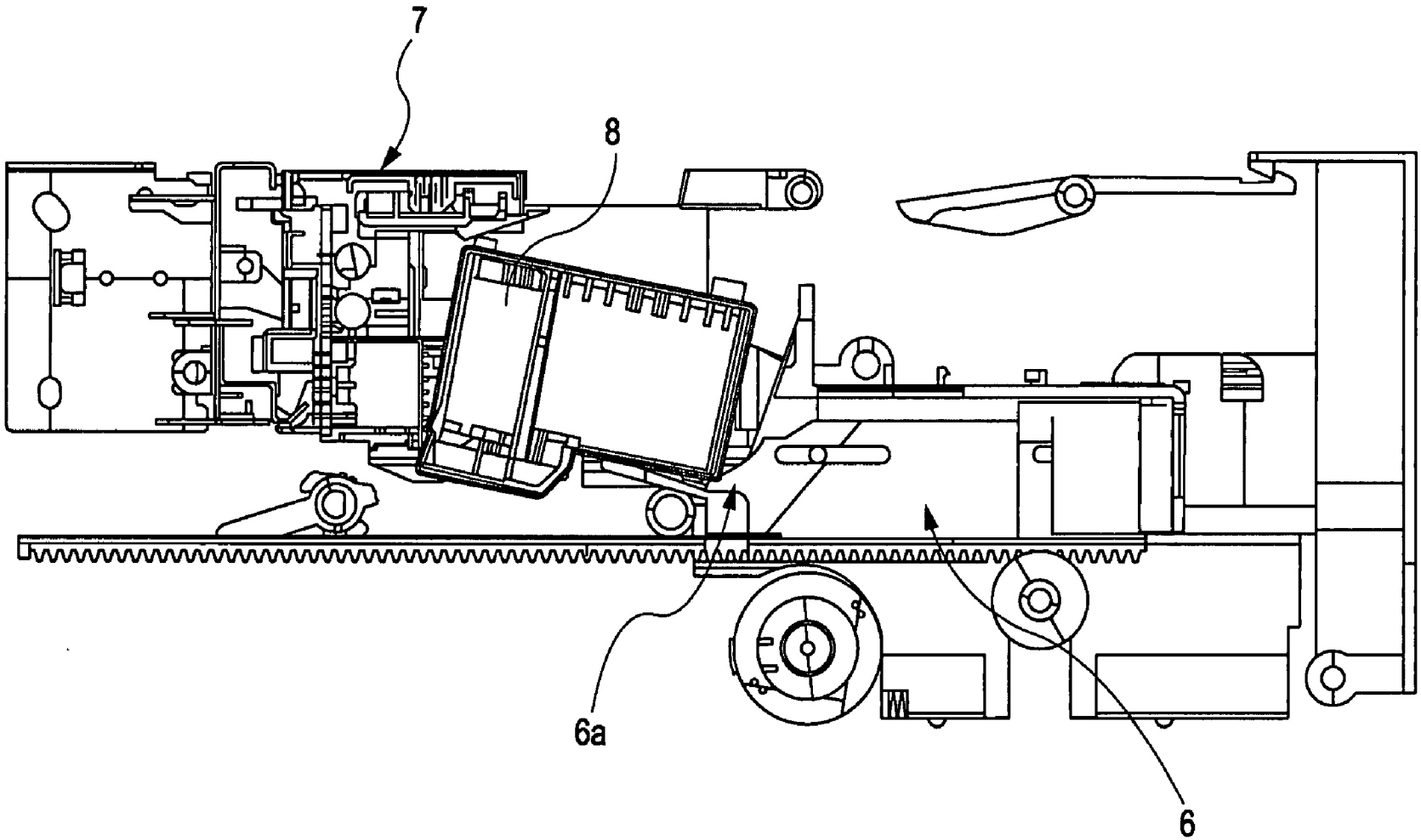
FIG. 13 is another diagram illustrating the recording-head replacing operation.

Then, the driving mechanism (not shown) moves the head-pushing member 6 in the direction shown by the arrow B in FIG. 12. Accordingly, as shown in FIG. 13, a head-pushing cam surface 6*a* provided on the head-pushing member 6 comes into contact with the bottom surface of the recording head 8 mounted on the head mount 5, and the recording head 8 starts moving from the head mount 5 to the carriage 7.

Figure 14:
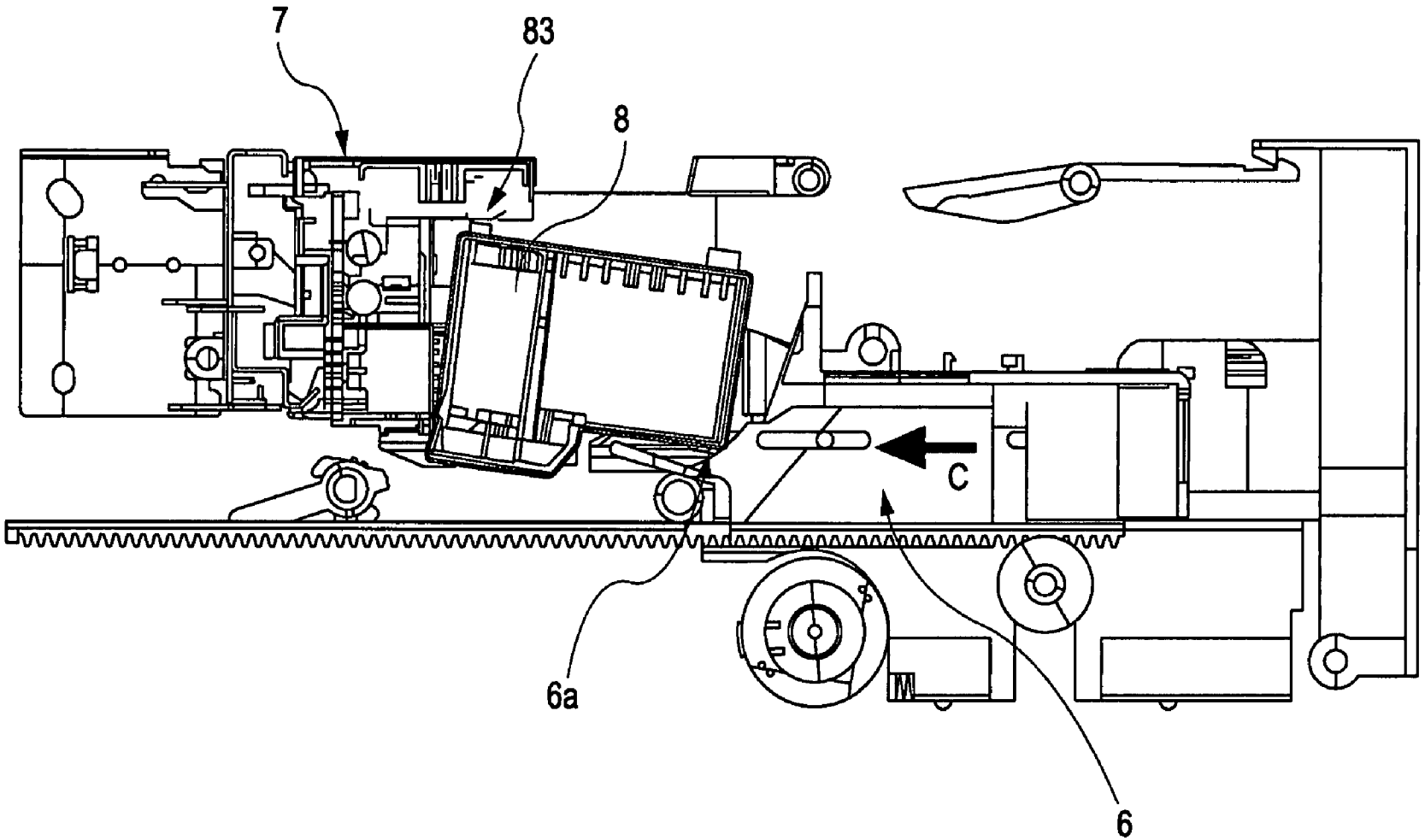
FIG. 14 is another diagram illustrating the recording-head replacing operation.
Figure 15:
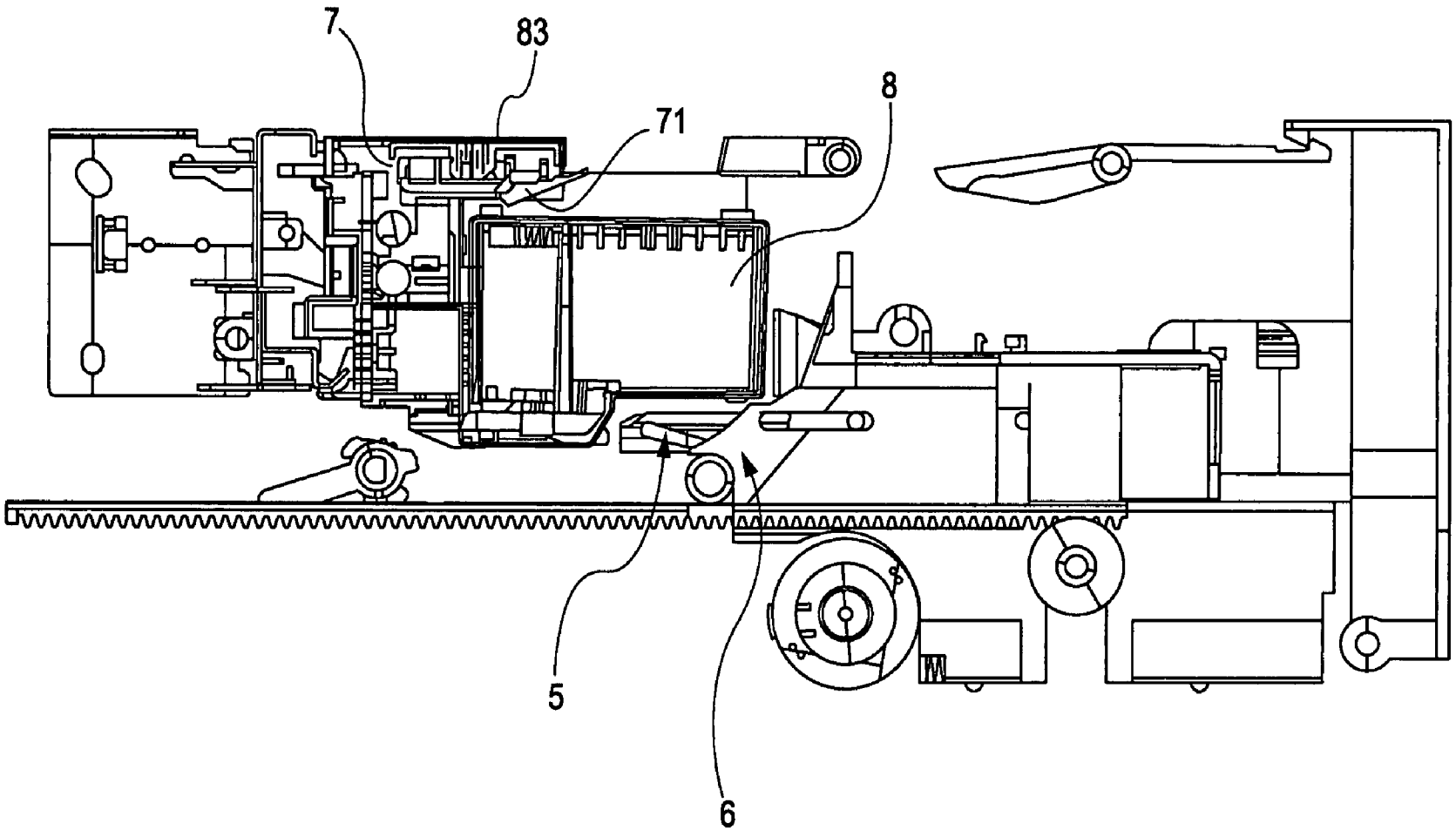
FIG. 15 is another diagram illustrating the recording-head replacing operation.

Then, as shown in FIG. 14, the head-pushing member 6 is further driven in the direction shown by the arrow C in FIG. 14. Accordingly, as shown in FIG. 15, the head-fixing portion 83 provided on the recording head 8 moves beyond the inclined surface of the recording head retaining member 71.

Figure 16:
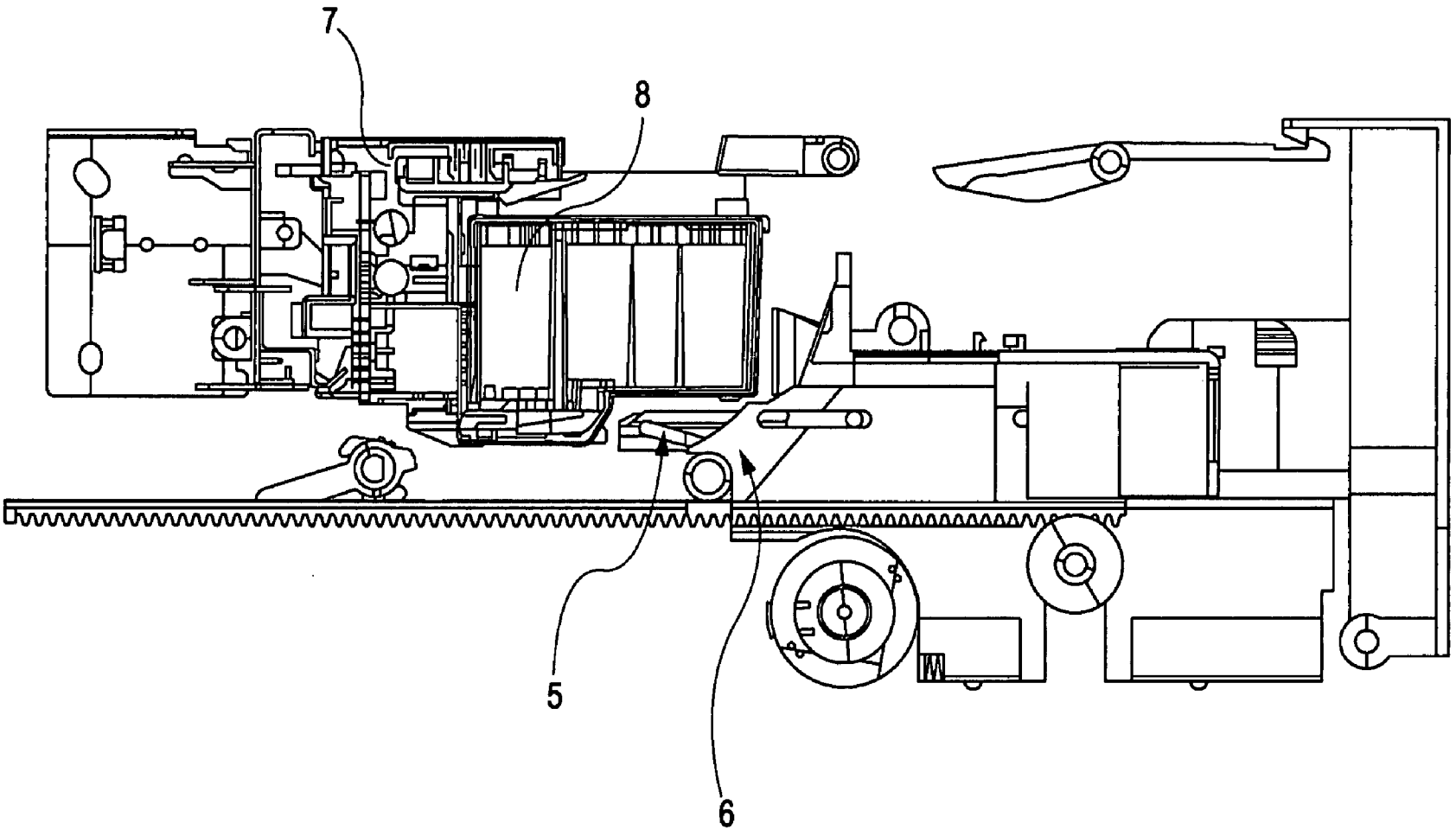
FIG. 16 is another diagram illustrating the recording-head replacing operation.

At this time, as shown in FIG. 16, the recording head 8 is fixed to the carriage 7 by an elastic force applied by the head-setting spring 72.

In addition, as described above, the carriage 7 has two pockets 73 and 74 that receive different recording heads 8. Therefore, when one of the recording heads 8 is to be replaced, the recording head 8 to be replaced can be selected depending on the position at which the carriage 7 stops, that is, depending on the head replacing position.

Accordingly, the structure in which all of the operations of feeding the recording sheet, ejecting the recording sheet, and replacing the recording heads 8 (ink units) can be performed on the front side of the apparatus is obtained without increasing costs. Therefore, the apparatus can be used without degrading the operational facility even when the apparatus is placed on a rack, and there is more freedom in the installation of the apparatus.

In addition, the recording heads 8 can be easily replaced even when the carriage 7 is placed at a deep position in the inkjet recording apparatus 100.

In addition, when, for example, the above-described structure is applied to a so-called multifunction printer having a flat head scanner mounted at the top, it is not necessary to lift the heavy scanner each time the recording heads 8 are replaced. In addition, since it is not necessary to provide a structure including a hinge or the like for lifting the scanner, the height of the apparatus can be reduced. Therefore, the overall size of the apparatus can be reduced.

Second Embodiment

Figure 17:
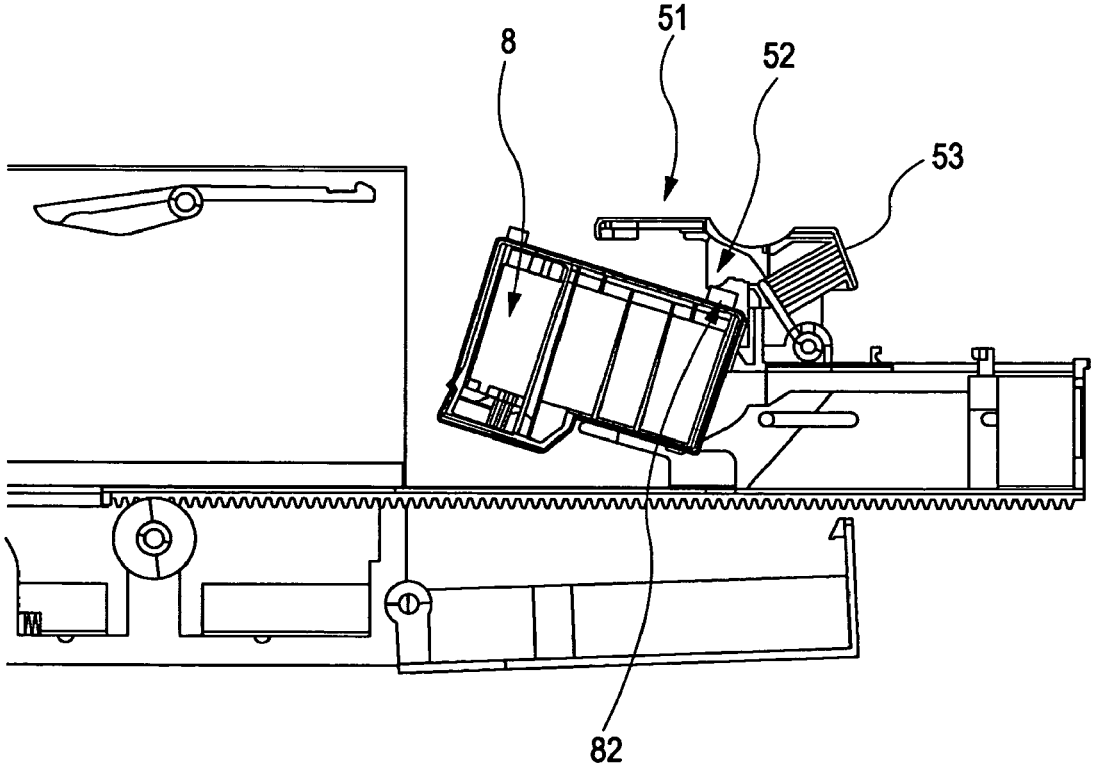
FIG. 17 is a diagram illustrating a recording-head replacing operation according to a second embodiment of the present invention.

Next, an inkjet recording apparatus according to a second embodiment of the present invention will be described below with reference to FIG. 17. FIG. 17 is a diagram illustrating a recording-head attaching/detaching operation according to the present embodiment. Components similar to those of the first embodiment are denoted by the same reference numerals, and explanations thereof are thus omitted.

As shown in FIG. 17, an inkjet recording apparatus according to the present embodiment includes a head-retaining unit including a head-hold lever 51, a head-hold claw 52, and a head-hold spring 53.

The head-hold claw 52 presses a finger tab 82 of a recording head 8 with a weak force applied by the head-hold spring 53, and thereby stabilizes the position of the recording head 8. The head-hold claw 52 and the head-hold spring 53 are operably associated with the head-hold lever 51, and are separated from the recording head 8 so as to release the recording head 8 when the head-hold lever 51 is rotated.

In the state in which the head-hold lever 51 is out of the apparatus body, the user can rotate the head-hold lever 51 to detach or attach the recording head 8.

Since the recording head 8 is retained and stabilized by a weak force as described above, the recording head 8 is prevented from falling from the head mount 5 when the recording head 8 is in the apparatus body, as shown in FIG. 6. Thus, the recording head 8 can be reliably attached or detached.

Third Embodiment

Figure 18:
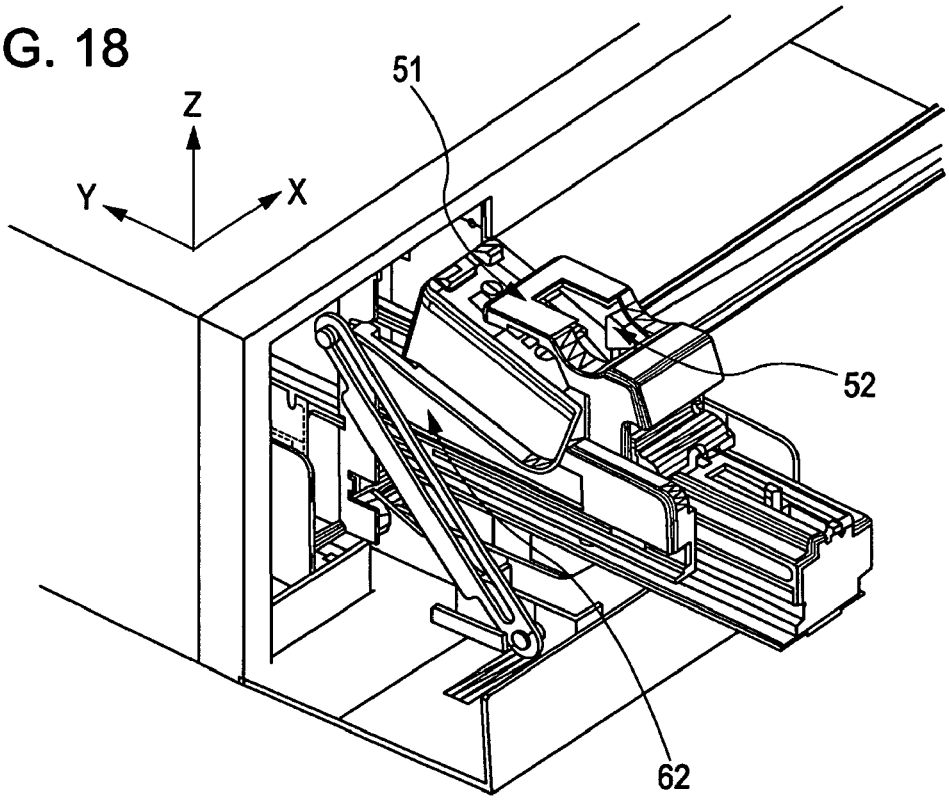
FIG. 18 is a diagram illustrating a recording-head replacing operation according to a third embodiment of the present invention.
Figure 19:
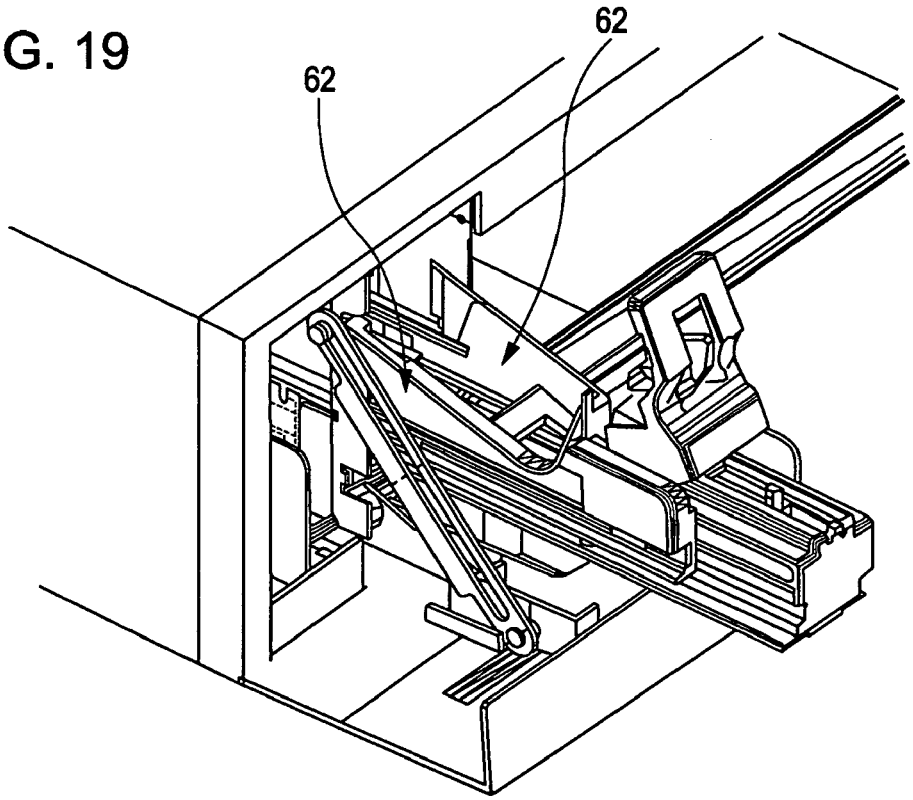
FIG. 19 is another diagram illustrating the recording-head replacing operation according to the third embodiment.

Next, the inkjet recording apparatus according to a third embodiment of the present invention will be described below with reference to FIGS. 18 and 19. FIGS. 18 and 19 are diagrams illustrating a recording-head attaching/detaching operation according to the present embodiment. Components similar to those of the second embodiment are denoted by the same reference numerals, and explanations thereof are thus omitted.

As shown in FIGS. 18 and 19, the inkjet recording apparatus according to the present invention includes head guide members 62 on both sides of a head mount 5 in the X direction. The head guide members 62 guide a recording head 8 so that the recording head 8 is prevented from being displaced in the X direction when the recording head 8 is outside the apparatus body. FIG. 18 shows the state in which the recording head 8 is moved out of the apparatus body. FIG. 19 shows a state after the recording head 8 is removed by rotating the head-hold lever 51.

Since the head guide members 62 are provided at both sides of the head mount 5 at a section where the recording head 8 is to be placed, the exact section where the recording head 8 is to be set can be clearly recognized by the user. In addition, the recording head 8 can be reliably set to the attach/detach position simply by placing the recording head 8 into the space surrounded by the head guide members 62 and operating the head-hold lever 51.

According to the present embodiment, the structure in which the operations of feeding the recording sheet, ejecting the recording sheet, and replacing the recording heads can be performed on the front side can be obtained without increasing costs.

While the present invention has been described with reference to exemplary embodiments, it is to be understood that the invention is not limited to the disclosed exemplary embodiments. The scope of the following claims is to be accorded the broadest interpretation so as to encompass all modifications, equivalent structures and functions.

This application claims the benefit of Japanese Application No. 2005-146381 filed May 19, 2005, which is hereby incorporated by reference herein in its entirety.

What is claimed is:

1. A recording apparatus that records on a recording sheet with a detachable recording head, the recording apparatus comprising:

an apparatus body having a front side;

a carriage movably supporting the detachable recording head;

a head-replacing portion arranged on the front side of the apparatus body and operable to perform a recording-head replacing operation;

a feeding unit arranged on the front side of the apparatus body and configured to feed the recording sheet;

an eject unit arranged on the front side of the apparatus body and configured to eject the recording sheet;

a head mount adapted to mount the recording head and movable between the carriage and the head-replacing portion;

a lowering member configured to move the recording head mounted on the carriage to the head mount; and a pushing member configured to move a newly replaced recording head mounted on the head mount back into the carriage.

2. The recording apparatus according to claim 1, wherein the recording head includes reference surfaces facilitating positioning the recording head in a first direction in which the carriage moves, a second direction in which the recording sheet is fed by the feeding unit, and a third direction perpendicular to the first and second directions.

3. The recording apparatus according to claim 1, wherein the recording head includes a head-fixing portion fixing the recording head to the carriage.

4. The recording apparatus according to claim 1, further comprising a head-retaining unit retaining the recording head on the head mount.

5. The recording apparatus according to claim 1, wherein the head mount includes a head guide member on each side of the head mount in a direction in which the carriage moves, the head guide member preventing the recording head from being displaced in the direction in which the carriage moves.

6. The recording apparatus according to claim 1, wherein the recording head includes an inkjet recording head configured to discharge ink on the recording sheet.

* * * * *